United States Patent [19]

Milov et al.

[11] Patent Number: 4,817,700

[45] Date of Patent: Apr. 4, 1989

[54] SQUEEZE-OUT CASTING MACHINE

[76] Inventors: Vladimir N. Milov, ulitsa Krivorozhskaya, 21, korpus 2, kv. 67; Anatoly A. Loginov, 7-yaParkovaya, 27, kv. 52, both of Moscow; Nikolai S. Ostrenko, deceased, late of Moscow; Viktor I. Gorsky, Slavyansky bulvar, 17, kv. 48; Nikolai A. Demyanovich, 1-y Goncharny pereulok, 7, kv. 108, both of Moscow; Rifkhat B. Davletkhanov, Institutsky pereulok, 6, kv. 52, Dolgoprudny Moskovskoi oblasti; Sergei N. Klimets, ulitsa Titova, 3, kv. 18, Kamensk-Uralsky Sverdlovskoi oblasti; Gennady P. Dokshin, ulitsa Dobroljubova, 3, kv. 31, Kamensk-Uralsky Sverdlovskoi oblasti; Jury A. Telyatnikov, ulitsa Tevosyana, 7, kv. 118, Kamensk-Uralsky Sverdlovskoi oblasti; Vladislav I. Yarkin, ulitsa Pushkina, 2, kv. 81, Kamensk-Uralsky Sverdlovskoi oblasti; by Ekaterina A. Ostrenko, administrator, Kosinskava ulitsa, 26, korpus 1, kv. 64, Moscow; by Inna E. Chevalkova, administrator, Proektiruemy proezd, 3, kv. 77, Moscow; by Alla E. Stebakova, administrator, ulitsa Lipetskaya, 11, korpus 1, kv. 171, Moscow, all of U.S.S.R.

[21] Appl. No.: 26,057

[22] Filed: Mar. 16, 1987

Related U.S. Application Data

[63] Continuation-in-part of Ser. No. 372,699, Apr. 28, 1982, abandoned.

[51] Int. Cl.[4] ..... B22D 27/11

[52] U.S. Cl. ..... 164/259; 164/321; 164/342; 164/319

[58] Field of Search ..... 164/66.1, 113, 120, 164/259, 284, 302, 340, 342, 319, 321

[56] References Cited

U.S. PATENT DOCUMENTS

| | | | |
|---|---|---|---|
| 1,944,461 | 1/1934 | Pike | 164/66.1 |
| 1,978,222 | 10/1934 | Otte | 164/66.1 |
| 3,279,005 | 10/1966 | Wehmeyer | 164/66.1 |
| 3,621,903 | 10/1971 | Doi | 164/66.1 |
| 3,697,038 | 10/1972 | Stebakov . | |
| 3,779,304 | 12/1973 | Miki | 164/113 |
| 4,519,437 | 5/1985 | Logvinov | 164/284 |

FOREIGN PATENT DOCUMENTS

| | | | |
|---|---|---|---|
| 1223358 | 6/1960 | France | 164/66.1 |
| 20274 | 7/1972 | Japan | 164/120 |
| 165557 | 12/1981 | Japan | 164/284 |
| 617164 | 7/1978 | U.S.S.R. | 164/284 |

OTHER PUBLICATIONS

"Light Metal Age", Dec. Issue, p. 11.
"Modern Casting", by A. J. Steiger, Aug. 1960.

*Primary Examiner*—Fred A. Silverberg
*Attorney, Agent, or Firm*—Burgess, Ryan & Wayne

[57] ABSTRACT

The squeeze-out casting machine comprises a base-plate for reciprocation therealong, half-molds and sealing jaws with pour-in ports adapted to overlap closingly as the half-molds are being brought together. The base-plate has rigidly secured theroen a centering pin supporting a frame with a core unit. The core unit defines jointly with the base plate, the sealing jaws and the portions of the half-molds adjoining the baseplate and a metal-receiving chamber. There is also an arrangement for supplying an inert gas communicating with the metal-receiving chamber.

3 Claims, 3 Drawing Sheets

F I G. I

SQUEEZE-OUT CASTING MACHINE

REFERENCE TO RELATED APPLICATION

This application is a continuation-in-part application of U.S. patent application Ser. No. 372,699, filed Apr. 28, 1982, now abandoned, to the same inventors and entitled Squeeze-Out Casting Machine.

FIELD OF THE INVENTION

The present invention relates to the foundry technology, and more particularly it relates to a squeeze-out casting machine.

The disclosed casting machine is preferably employed for manufacturing thin-wall large castings of non-ferrous metal alloys.

BACKGROUND OF THE INVENTION

It is generally known that when a molten metal is poured into a mold, the surface of the metal becomes oxidized. The structure of a casting becomes of poor quality on account of the presence therein of oxide inclusions affecting the mechanical properties of the casting, its strength in particular. Moreover, in some cases, the castings are to be made of highly active metals which are liable to self-inflame when contacting the ambient air, which might cause a case of emergency. The use of flour of sulfur for prevention of self-inflammation of a metal results in polluting the casting with the components of the flux, which likewise affects the mechanical properties of the casting. To avoid surface oxidation of the metal, besides the application of flour of sulfur, there are also used inert gases -argon and others, or else there is a pre-evacuation of the mold. The last-mentioned technique, however, is applicable solely in pressure-die casting or else in arc-type vacuum casting machines.

There is known a pressure-die casting machine (cf. SU Inventor's Certificate No. 438,496; Int. Cl.$^2$ B 22 D 17/14) comprising half-molds movably mounted on a baseplate, a pouring bowl and a unit for pressing-in the metal.

To produce a casting, vacuum is generated in the working cavity defined by the half-molds. Then a portion of the metal, sufficient for making one casting, is poured into the pouring bowl, and the pressing-in unit is operated to inject the metal into the working cavity. The vacuum generated in the working cavity protects the metal against the formation of oxide films.

However, a machine of this kind is operable solely for casting machine parts of relatively small dimensions, whereas casting of large parts, involving the use of bulky cores, is virtually impossible.

There is further known a pressure-die casting machine (cf. JA Patent No. 52-26741; Int. Cl.$^2$ B 22 D 17/20) comprising a bed supporting a movable plate and a stationary one having the half-molds mounted thereon. The bed further supports a unit for pressing-in the metal, a mechanism for ejecting a casting and a device for purging the working cavity of the mold or die.

This machine is suitable for pressure-die casting. The working cavity is filled with the inert gas in a closed space, with the supply of the inert gas protecting the metal against oxidation. However, same as in the previously described case, the machine cannot be used for making castings of large parts.

There is still further known, a squeeze-out casting machine comprising a baseplate having reciprocably mounted thereon the half-molds and sealing jaws with pour-in ports adapted to overlap closingly as the half-molds are brought together, and a centering pin rigidly secured on the baseplate and supporting a frame with the core unit defining jointly with the baseplate, the sealing jaws and the portions of the half-molds, adjoining the baseplate, a metal-receiving chamber (cf. Vinogradov, V. N. "Casting Molds for Non-Ferrous Alloys", Album of Designs, MASHINOSTROYENIYE Publishers, Moscow, 1981, Sheet 28, in Russian).

The machine is suitable for making large castings but of a limited range of metals. At present, machines of this type are used solely with aluminum and zinc alloys. The absence of facilities for protection against the action of the ambient atmosphere upon the melt results in the formation of oxide films in and on the castings, with their mechanical properties becoming correspondingly affected. The present-day requirements of reducing the weight of castings and enhancing their mechanical strength call for the use of more lightweight alloys. However, alloys of lightweight metals require positive protection against the action of the ambient atmosphere.

SUMMARY OF THE INVENTION

It is an object of the present invention to create a machine for squeeze-out casting, which should be usable for casting large articles of enhanced quality.

This and other objects are attained in a squeeze-out casting machine comprising a baseplate supporting half-molds reciprocable therealong and sealing jaws with pour-in ports adapted to be closed by overlapping when said half-molds are brought together, a centering pin rigidly secured on said baseplate and supporting a frame with a core unit defining jointly with the baseplate, the sealing jaws and the portions of the half-molds, adjoining the baseplate, a metal-receiving chamber, which machine, in accordance with the invention, further comprises an arrangement for supplying an inert gas, communicating with the metal-receiving chamber.

It is expedient that the arrangement for supplying an inert gas should include pipes in a number equalling that of the pour-in ports, mounted on the sealing jaws for rotation about a horizontal axis, the pipes being received, as the metal is being poured in, in the pour-in ports, tangentially to the internal surfaces, so that the outlets of the pipes should face in the same direction.

It is still further expedient that the arrangement for supplying an inert gas should include ducts provided in the walls of the half-molds, adjoining the baseplate, the axes of the ducts extending at an angle to the internal surface of the walls of the metal-receiving chamber to swirl the stream of the inert gas above the metal.

It may be useful to have the arrangement for supplying the inert gas including additional ducts made in the face of the baseplate, with the axes of these ducts extending at an angle to the surface of the metal-receiving chamber, symmetrically with the axes of the main ducts.

The herein disclosed structure of a squeeze-out casting machine incorporating an arrangement for supplying an inert gas allows the strength-related properties of castings to be significantly enhanced. Besides, the opportunity of casting highly active lightweight metals with the strength-related properties above those of the presently employed metals has been provided for.

BRIEF DESCRIPTION OF THE DRAWINGS

The invention will be further described in connection with practical embodiments thereof, with reference being made to the accompanying drawings, wherein.

DISCLOSURE OF THE INVENTION

Figure 1:
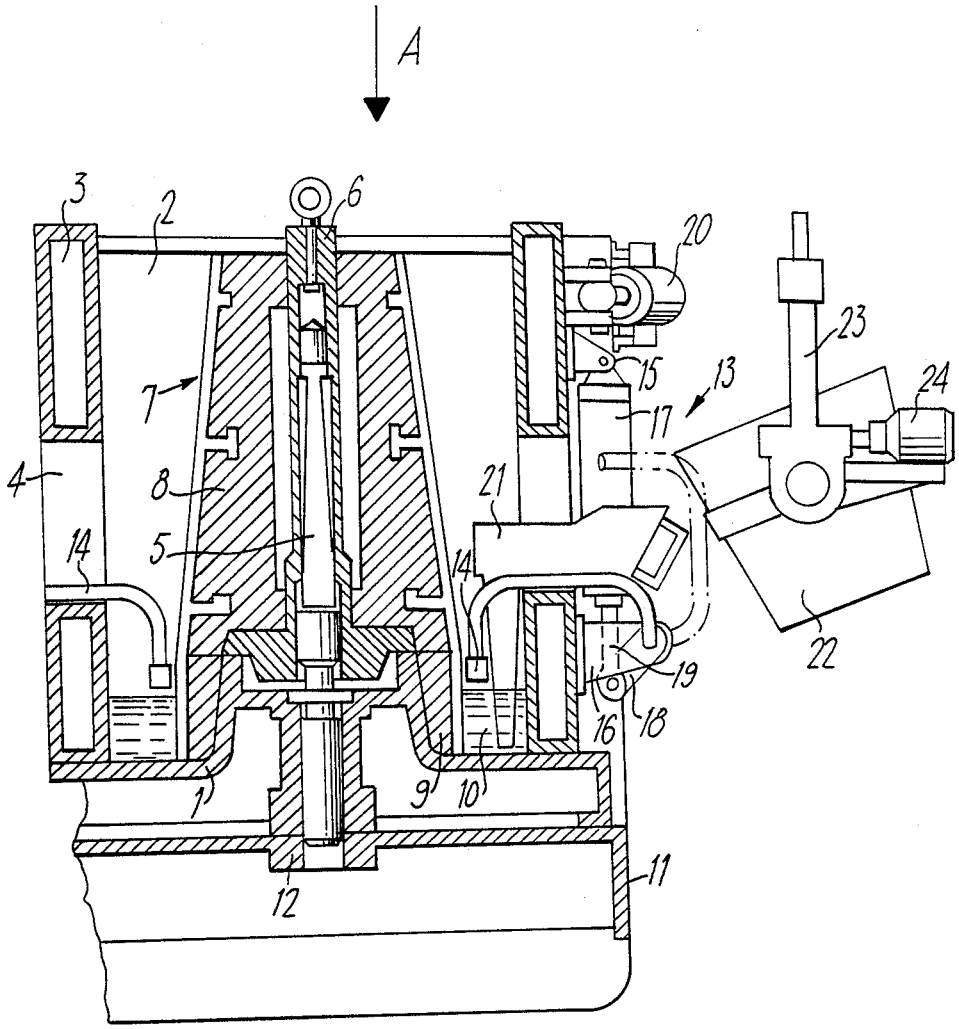
FIG. 1 is a longitudinal section view of a squeeze-out casting machine embodying the invention.

Referring now in particular to the accompanying drawings, a machine for squeeze-out casting comprises a baseplate 1 (FIG. 1) supporting half-molds 2 reciprocably mounted thereon. These parts of a complete mold are referred to here as "half-molds" in accordance with the accepted terminology, although the exact number of these "half-molds" may be in excess of two. In the embodiment described, the squeeze-out casting machine actually has but two half-molds 2.

The baseplate 1 also has movably mounted thereon sealing jaws 3 with pour-in ports 4 adapted to close by overlapping when the half-molds 2 are brought together. Rigidly secured on the baseplate 1 is a centering pin 5 adapted to support a frame 6 with a core block or unit 7. In the embodiment being described, the core unit 7 includes a main core 8 and a core 9. The shape of the surface of the core unit 7 is intended to shape the inner surface of a casting, while the internal surface of the half-molds 2 shapes the outer surface of the casting.

The core 9 jointly with the baseplate 1, the sealing jaws 3 and the portions of the half-molds 2, adjoining the baseplate 1, define the metal-receiving chamber 10. The baseplate 1 is fastened with a bed 11, with the baseplate 1 and the bed 11 having an aligned opening 12 receiving the end portion of the centering pin 5.

The machine further comprises a device or arrangement 13 for supplying an inert gas, communicating with the metal-receiving chamber.

In the embodiment being described, the arrangement 13 for supplying an inert gas includes pipes 14 whose number equal that of the pour-in ports 4. The pipes 14 are mounted on the jaws 3 for rotation about a horizontal axis.

While the molten metal is being poured in, the pipes 14 extend in the pour-in ports 4 tangentially to the inner surface of the half-molds 2, so that the outlets of the pipes should face in the same direction.

Brackets 15 and 16 are mounted on the jaws 3, the bracket 15 rigidly supporting the actuator 17 for rotating the pipes, while the bracket 16 has an opening movably receiving the end portion of the respective pipe 14. The same end portion of the pipe 14 is fastened with a shackle 18 whose opposite end is connected to the rod 19 of the actuator 17 for rotating the pipe 14.

Figure 2:
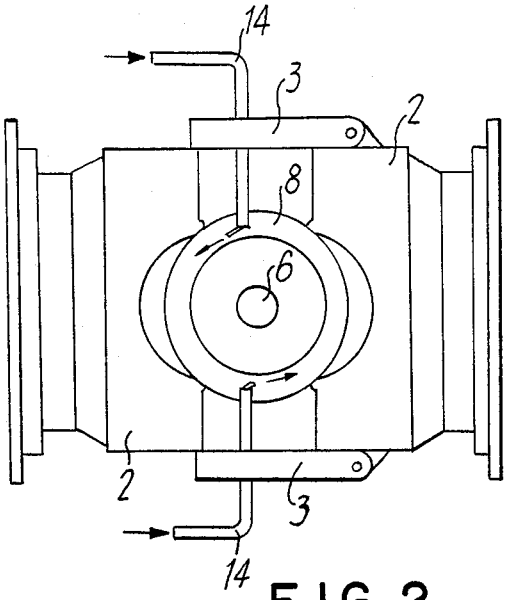
FIG. 2 shows the squeeze-out casting machine embodying the invention, viewed along arrow A of FIG. 1.

The half-molds 2 have rigidly mounted thereon a drive 20 for moving the sealing jaws 3. The full set of the squeeze-out casting machine further includes two pour-in funnels 21 receivable in the ports 4 when the molten metal is being poured in. Prior to closing the half-molds 2 upon each other, the funnels 21 are withdrawn from the metal-receiving chamber 10. To pour in molten metal, a pouring ladle 22 is used. The pouring ladle 22 is supported on a rod 23 and is rotatable by an electric drive 24. FIG. 2 illustrates one version of receiving the pipes 14 in the pour-in ports of the sealing jaws 3, with the outlets of the pipes 14 extending tangentially to the inner surface of the walls of the metal-receiving chamber 10.

There may be another arrangement of the device 13 for supplying an inert gas, including ducts 25 (FIG. 3) made in the walls of the half-molds 2, adjoining the baseplate 1. The axes of the ducts 25 extend at an angle to the inner surface of the walls of the metal-receiving chamber 10, in a horizontal plane which is essential for swirling the stream of the inert gas above the molten metal and to provide a dense layer of the gas. To feed in the inert gas, the half-mold 2 of this embodiment has pipes 26 whose ends communicate with a manifold 27 provided in the walls of the half-molds 2. The opposite ends of the pipes 26 communicate with a vessel (not shown in FIG. 3) with a supply of the inert gas.

Figure 4:
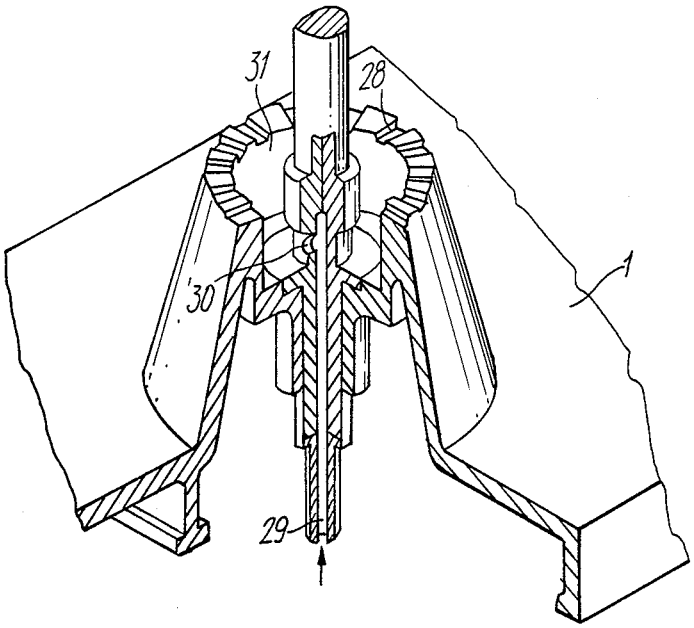
FIG. 4 is a partly cutaway isometric projection of the baseplate of the machine with ducts for supplying an inert gas in accordance with the invention.
Figure 5:
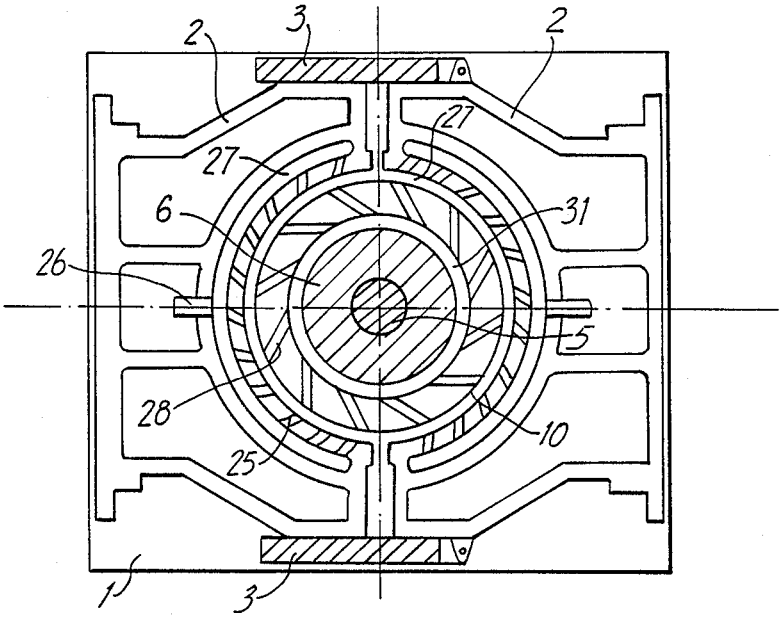
FIG. 5 is a cross-sectional view of the squeeze-out casting machine of FIG. 3 taken along line B—B thereof.

To provide a more dense layer of the inert gas, the end face of the baseplate has additional ducts 28 (FIG. 4) made therein, their axes extending at an angle in a horizontal plane to the surface of the metal-receiving chamber 10, in the same direction with the axes of the main ducts 25. To feed in the inert gas, an opening 29 is made in the body of the centering pin 5, merging with a horizontal through bore 30 communicating with a manifold 31 made in the baseplate 1.

An embodiment is also possible (not shown in the accompanying drawings) where the arrangement 13 for supplying an inert gas includes both the pipes 14 and ducts 25, which is essential for making castings of lightweight metals.

The squeeze-out casting machine is operated, as follows.

First, the half-molds 2 are partly brought together.

Figure 3:
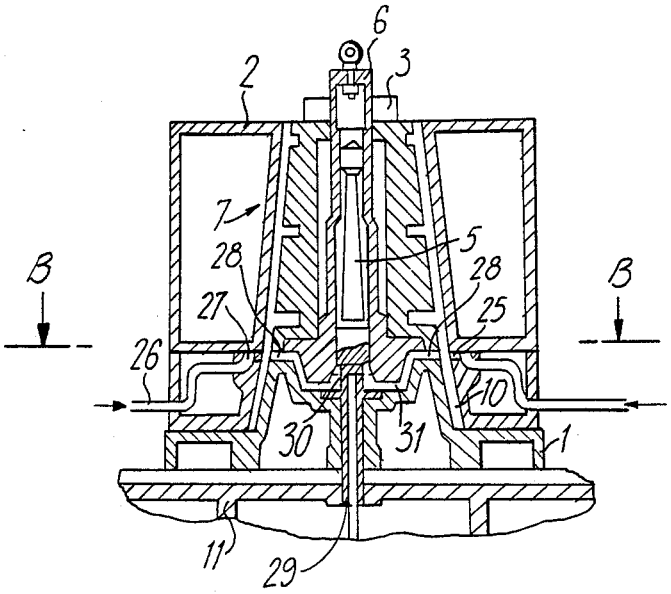
FIG. 3 is a longitudinal section view of a squeeze-out casting machine embodying the invention, with a modified structure of the arrangement for supplying an inert gas.

The actuator 17 (FIG. 1) is operated to introduce the pipes 14 by their rotation into the heated metal-receiving chamber 10 through the pour-in ports 4 of the sealing jaws 3. Then the pour-in funnels 21 are set into place. An inert gas - argon - is supplied via the pipes 26 (FIG. 3). The gas fills the inner space of the metal-receiving chamber 10, and with the outlets of the pipes 14 facing in the same direction, the stream of the gas is swirled to provide a protective layer preventing oxidation of the molten metal.

The molten metal is poured into the metal-receiving chamber 10 from the ladle 22 through the pour-in funnels 21, with the gas being ousted in the upward direction by the incoming melt and remaining atop the metal surface. With the pouring-in completed, the pour-in funnels 21 are withdrawn through the pour-in ports 4. The feed of the inert gas is terminated and the actuator 17 is operated to withdraw the pipes 14 from the pour-in ports by rotation of the pipes 14. Then the half-molds 2 are finally brought together or closed upon each other and the casting of a still liquid metal is finally shaped. As the casting is being thus shaped, the layer of the inert gas remains atop the metal rising in the internal space of the mold.

The operation of the machine of the other described embodiment is, as follows.

The pour-in funnels 21 are introduced into the heated metal-receiving chamber 10 (FIG. 3) via the pour-in ports 4. Then the inert gas is fed into the manifold 27 via the pipes 26, wherefrom it passes into the manifold 31 via the opening 29 and through the bore 30 in the centering pin 5, whereupon the gas enters the metal-receiving chamber 10 via the ducts 25 and the ducts 28 in the face of the baseplate 1. Owing to the ducts extending at an angle to the inner surface of the metal-receiving chamber 10, the stream of the inert gas is swirling, yielding the outcome characterized while describing the previous embodiment. With the metal-receiving chamber 10 filled with the inert gas, the ladle 22 is operated to pour in the metal through the funnels 21. With the pouring-in completed, the funnels 21 are withdrawn from the metal-receiving chamber 10, the feed of the inert gas is terminated, and the half-molds 2 are finally brought together to close upon each other. The gas ousted from the metal-receiving chamber rises atop the rising surface of the metal, thus protecting it from the action of the oxidizing agents in the ambient air.

In this way, the metal being poured in is protected against self-inflammation and oxidation.

The secondly described embodiment of the invention is more suitable for applications where the layer of the metal poured into the metal-receiving chamber 10 is below the face of the baseplate 1. When this metal layer initially poured into the metal-receiving chamber 10 is above the face of the baseplate 1, the first-described embodiment of the arrangement 13 for supplying the inert gas is preferably used.

In regard to possible melt penetration in the ducts 25 and 28 for supplying an inert gas, such penetration was not observed by the inventors in actual constructions. The reason for such lack of penetration is believed to be that, when the diameter of the outlets of the ducts or the height of the slot is within 0.1 to 0.15 mm, for example, and for aluminum-magnesium alloys, during the melt rise in the course of its squeezing out, an alloy crystal crust was formed which closed the mouth of the ducts and prevented further penetration of the melt inside the ducts. In any event, this problem does not occur in actual constructions.

Having described specific preferred embodiments of the invention with reference to the accompanying drawings, it will be appreciated that the present invention is not limited to those precise embodiments, and that various changes and modifications can be effected therein by one of ordinary skill in the art without departing from the spirit or scope of the invention as defined in the appended claims.

What is claimed is:

1. A machine for squeeze-out casting, comprising a baseplate;

a first and second half-molds mounted on said baseplate;

a drive operatively connected with said half-molds for reciprocating the half-molds along said baseplate two sealing jaws mounted on said baseplate for reciprocation under the action of said drive;

pour-in ports defined in said sealing jaws, adapted to be closed by overlapping as said half-molds are brought together;

a centering pin rigidly secured on said baseplate;

a frame supported by said centering pin;

a core unit mounted on said frame;

a metal-receiving chamber defined by said core unit, said baseplate, said sealing jaws and portions of said half-molds adjoining said baseplate; and means for reducing convective streams of air introduced into the chamber and for creating a gas cushion of an inert gas above a melt introduced into the metal-receiving chamber by an arrangement for supplying an inert gas communicating with said metal-receiving chamber wherein said arrangement for supplying an inert gas includes:

a plurality of ducts defined in walls of said half-molds adjoining said baseplate;

said walls having an inner surface;

said ducts having longitudinal axes extending at an angle to the inner surface of the walls of said metal-receiving chamber, for swirling the stream of the inert gas being fed above the surface of the molten metal.

2. A machine as set forth in claim 1, wherein said arrangement for supplying an inert gas additionally includes:

a plurality of ducts defined in the face of said baseplate;

said ducts having longitudinal axes extending at an angle in a horizontal plane to the surface of said metal-receiving chamber in the same direction with said axes of said plurality of ducts made in the walls of said half-molds.

3. A machine for squeeze-out casting, comprising:

a baseplate;

first and second half-molds mounted on said baseplate;

a drive operatively connected with said half-molds for reciprocating the half-molds along said baseplate;

two sealing jaws mounted on said baseplate for reciprocation under the action of said drive;

pour-in ports defined in said sealing jaws adapted to be closed by overlapping as said half-molds are brought together;

a centering pin rigidly secured on said baseplate;

a core unit mounted on said frame;

a metal-receiving chamber defined by said core unit, said baseplate, said sealing jaws and portions of said half-molds adjoining said baseplate; and means for reducing convective streams of air introduced into the chamber and for creating a gas cushion of an inert gas above a melt introduced into the metal-receiving chamber by an arrangement for supplying an inert gas communicating with said metal-receiving chamber, wherein said arrangement for supplying an inert gas includes:

a plurality of pipes in a number equalling that of said pour-in ports, mounted on said sealing jaws for rotation about a horizontal axis and adapted to be received in said pour-in ports as molten metal is being poured in tangentially to the inner surface of said half-molds;

outlets of said pipes, facing in the same direction;

a plurality of ducts defined in walls of said half-molds, adjoining said baseplate;

said walls having an inner surface;

said ducts having longitudinal axes extending at an angle to the inner surface of the walls of said metal-receiving chamber, for swirling the stream of the inert gas being fed above the surface of the molten metal.

* * * * *